US009376638B2

(12) United States Patent
Van Dijk

(10) Patent No.: US 9,376,638 B2
(45) Date of Patent: Jun. 28, 2016

(54) MULTI-STAGE HYDROCRACKING PROCESS FOR THE HYDROCONVERSION OF HYDROCARBONACEOUS FEEDSTOCKS

(75) Inventor: Nicolaas Van Dijk, Amsterdam (NL)

(73) Assignee: Shell Oil Company, Houston, TX (US)

( * ) Notice: Subject to any disclaimer, the term of this patent is extended or adjusted under 35 U.S.C. 154(b) by 263 days.

(21) Appl. No.: 14/119,896

(22) PCT Filed: May 25, 2012

(86) PCT No.: PCT/EP2012/059882

§ 371 (c)(1),
(2), (4) Date: Jan. 8, 2014

(87) PCT Pub. No.: WO2012/163850

PCT Pub. Date: Dec. 6, 2012

(65) Prior Publication Data

US 2014/0110306 A1 Apr. 24, 2014

(30) Foreign Application Priority Data

May 27, 2011 (EP) ..... 11167820

(51) Int. Cl.

*C10G 65/10* (2006.01)
*C10G 47/12* (2006.01)
*C10G 65/02* (2006.01)

(52) U.S. Cl.

CPC ..... *C10G 65/10* (2013.01); *C10G 47/12* (2013.01); *C10G 2300/4081* (2013.01); *C10G 2400/02* (2013.01); *C10G 2400/06* (2013.01); *C10G 2400/08* (2013.01)

(58) Field of Classification Search

CPC ..... C10G 65/02; C10G 65/10
See application file for complete search history.

(56) References Cited

U.S. PATENT DOCUMENTS

| | | | |
|---|---|---|---|
| 4,203,825 | A | 5/1980 | Kmak et al. |
| 4,214,976 | A | 7/1980 | Kmak |
| 4,222,852 | A | 9/1980 | Kmak et al. |
| 4,608,153 | A | 8/1986 | Hudson et al. |
| 4,618,412 | A | 10/1986 | Hudson et al. |
| 4,624,776 | A | 11/1986 | Long et al. |

(Continued)

FOREIGN PATENT DOCUMENTS

| | | | |
|---|---|---|---|
| CN | 1083477 | C | 3/1984 |
| CN | 1692152 | A | 3/2012 |
| EP | 0015087 | | 9/1980 |
| EP | 0224944 | | 4/1984 |

(Continued)

*Primary Examiner* — Brian McCaig
(74) *Attorney, Agent, or Firm* — Charles W. Stewart

(57) ABSTRACT

A process for the hydroconversion of a hydrocarbon feedstock. The process includes contacting the hydrocarbon feedstock with a catalyst in a first hydrocracking section to obtain a first hydrocarbon effluent stream which is separated into a gaseous stream, a light liquid stream and a heavy liquid stream. These liquid streams are fractioned into a number of fractions of hydrocarbons including a fraction of hydrocarbons having a boiling point above 350° C. This fraction of hydrocarbons is contacted with a catalyst in a second hydrocracking section to obtain a second hydrocarbon effluent stream that is separated to obtain a gaseous stream, a light liquid stream and a heavy liquid stream. These liquid streams are fractioned into a number of fractions of hydrocarbons including a heavy fraction of hydrocarbons having a boiling point above 350° C. This fraction of hydrocarbons is split into a major stream and a minor stream with the major stream being recycled and the minor stream is recovered.

10 Claims, 1 Drawing Sheet

(56) References Cited

U.S. PATENT DOCUMENTS

| | | | |
|---|---|---|---|
| 4,664,777 | A | 5/1987 | Hudson et al. |
| 4,961,839 | A | 10/1990 | Stine et al. |
| 4,962,271 | A | 10/1990 | Black et al. |
| 5,120,426 | A | 6/1992 | Johnston et al. |
| 6,858,128 | B1 | 2/2005 | Hoehn et al. |
| 2004/0074810 | A1* | 4/2004 | Hoek ..... C10G 2/32 208/113 |

FOREIGN PATENT DOCUMENTS

| | | |
|---|---|---|
| EP | 0211593 | 2/1987 |
| EP | 0434342 | 6/1991 |

* cited by examiner

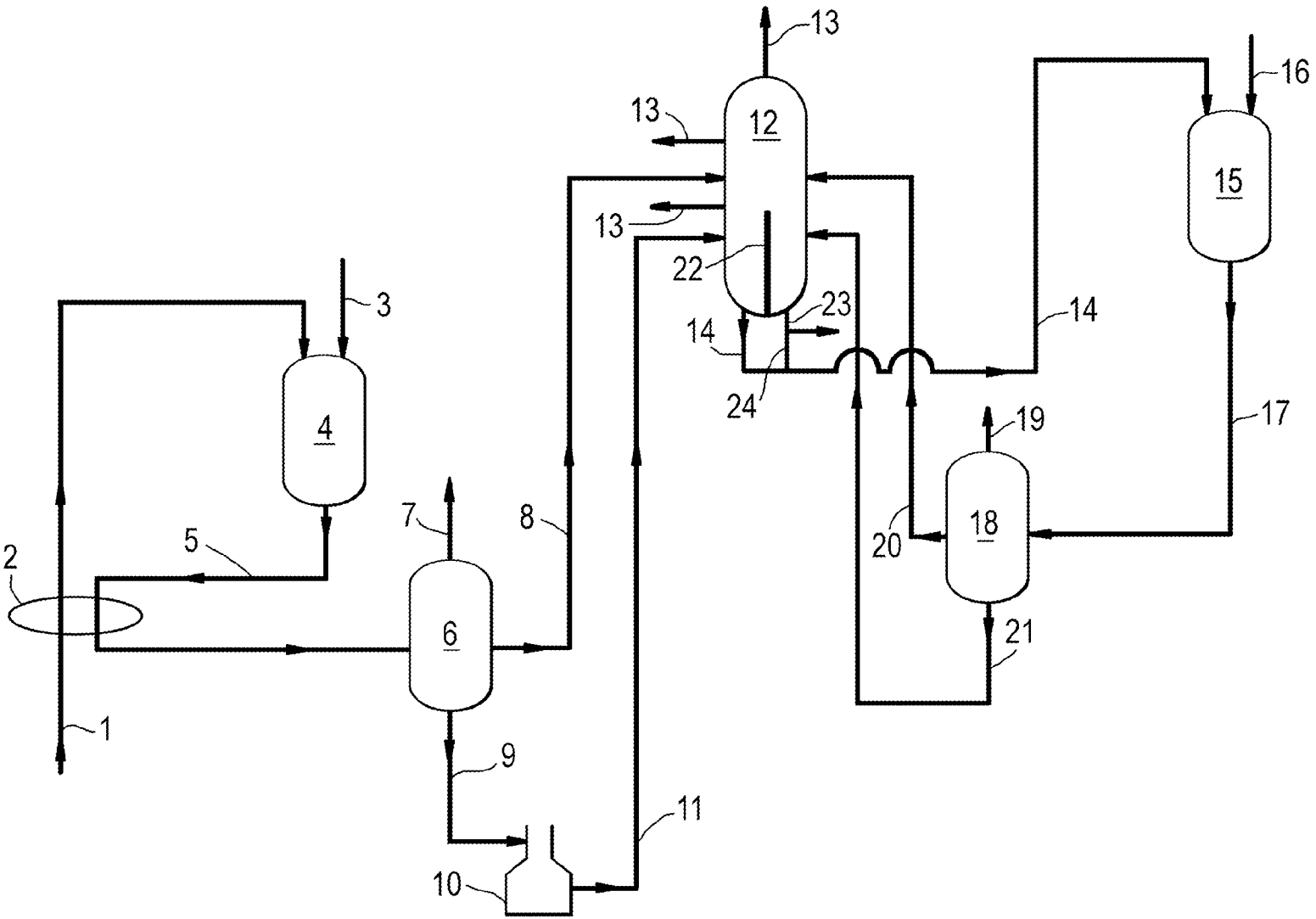
1
2
3
4
5
6
7
8
9
10
11
12
13
13
13
14
14
15
16
17
18
19
20
21
22
23
24

MULTI-STAGE HYDROCRACKING PROCESS FOR THE HYDROCONVERSION OF HYDROCARBONACEOUS FEEDSTOCKS

PRIORITY CLAIM

The present application is a National Stage (§371) application of International Application No. PCT/EP2012/059882, filed 25 May 2012, which claims the benefit of European Application No. 11167820.7, filed 27 May 2011, the disclosures of which are incorporated herein by reference.

FIELD OF THE INVENTION

The present invention relates to a process for the hydroconversion of a hydrocarbonaceous feedstock.

BACKGROUND OF THE INVENTION

It is known to prepare hydrocarbon fractions such as naphtha, kerosene and gas oil by means of two-stage hydrocracking of heavy hydrocarbon oils, such as vacuum distillates of crude mineral oil. To this end a heavy hydrocarbon oil will be hydrocracked in a first stage reaction section, the hydrocracked effluent will be passed through a heat exchanger to pre-heat the feedstock for the first stage, and the hydrocracked effluent will subsequently be passed through a furnace to reheat the hydrocarbon effluent before entering the distillation unit. In the distillation unit the hydrocracked effluent from the first stage reaction section will be separated by distillation into one or more light hydrocarbon fractions and a heavy hydrocarbon fraction. The heavy hydrocarbon fraction will be fed to a second stage hydrocracking reaction section. Before entering the second stage the heavy hydrocarbon fraction from the distillation unit will be heated by means of a heat exchanger using heat of the hydrocracked effluent from the second stage. The hydrocracked effluent obtained from the second stage reaction section will also be reheated by means of a furnace, and separated by distillation into one or more light hydrocarbon fractions and a heavy hydrocarbon fraction. The heavy hydrocarbon fraction so obtained from the hydrocracked effluent from the second stage will be recycled from the distillation unit to the second stage, whereas light hydrocarbon fractions separated in the distillation are recovered as the desired end products. The hydrocracked product streams from the first and second reaction stages will usually both have a temperature of about 250° C.

A drawback of such a known two-stage hydrocracking process is the build up of so-called polyaromatic compounds (PCAs) in the recycle stream from the distillation unit to the second stage when very high conversion levels are applied in the processing of heavy feedstocks. At high levels such polyaromatic compounds will deposit in the recycle circuit as a result of which equipment such as heat exchangers will become blocked and the energy efficiency of the two-stage hydrocracking process will be seriously affected.

In order to deal with this problem of PCAs build up various approaches have been suggested. It has for example been proposed to apply a substantial bleed stream of the heavy recycle product which contains PCAs. However, this reduces the overall conversion of the feedstock and results in a reduced yield of valuable lighter products such as high quality kerosene, and high quality gas oil.

In U.S. Pat. No. 4,961,839 a hydrocracking process is described, wherein a method is disclosed for counteracting the formation and accumulation of polycyclic aromatic compounds within a hydrocracking process unit. The bottoms fraction comprising the PCA's is removed. The disadvantage of the process as described in U.S. Pat. No. 4,961,839 is that the overall conversion of the feedstock is reduced and results in a reduced yield of valuable lighter products such as high quality kerosene, and high quality gas oil.

U.S. Pat. No. 5,120,426 describes an improved hydrocracking process, wherein the feed comprises foulant. The bottoms of the hydrocracker is being cooled in heat exchangers. The foulants are being removed via cooling and filtering. A disadvantage of the process is that these filters need to be replaced.

U.S. Pat. No. 6,858,128 describes a catalytic hydrocracking process with one hydrocracking reactor. The stream comprising an enhanced level of heavy polynuclear aromatic compounds is removed from the divided wall fractionator.

In addition to the above, it has been suggested to adsorb PCAs from the recycle stream by using activated coal. Such an approach, however, requires additional equipment, whereas the active coal loaded with the carcinogenic PCAs needs subsequently to be disposed of.

Thus, there is a need for a multi-stage hydrocracking process wherein the above disadvantage of PCAs build up is sufficiently dealt with in an attractive economic manner.

SUMMARY OF THE INVENTION

It has now been found that this can attractively be realised when the effluent stream of the second stage has a particular temperature and only part of the heavy hydrocarbon fraction of said effluent stream is recycled to the second stage.

Accordingly, the present invention relates to a process for the hydroconversion of a hydrocarbonaceous feedstock comprising the steps of:

(a) contacting the feedstock at an elevated temperature and pressure in a first hydrocracking section in the presence of hydrogen with one or more catalysts to obtain a first hydrocarbon effluent stream;

(b) separating at least part of the first hydrocarbon effluent as obtained in step (a) in a separating section into a gaseous stream, a light liquid stream and a heavy liquid stream;

(c) separating at least part of the liquid streams as obtained in step (b) in a fractionating section into a number of fractions of hydrocarbons including a heavy fraction of hydrocarbons that have a boiling point above 350° C.;

(d) contacting at least part of the heavy fraction of hydrocarbons that have a boiling point above 350° C. fraction as obtained in step (c) at an elevated temperature and pressure in a second hydrocracking section in the presence of hydrogen with one or more catalysts to obtain a second hydrocarbon product effluent;

(e) separating at least part of the second hydrocarbon effluent stream as obtained in step (d) in a separating section into a gaseous stream, a light liquid stream and a heavy liquid stream;

(f) separating at least part of the liquid streams as obtained in step (e) in a fractionating section into a number of fractions of hydrocarbons including a heavy fraction of hydrocarbons that have a boiling point above 350° C.;

(g) splitting at least part of the heavy fraction of hydrocarbons that have a boiling point above 350° C. as obtained in step (f) into a major stream and a minor stream;

(h) recycling at least part of the major stream as obtained in step (g) to step (d); and (i) recovering the minor stream as obtained in step (g).

In accordance with the present invention a more efficient and simple two-stage hydrocracking process is provided.

DETAILED DESCRIPTION OF THE INVENTION

The present invention relates to a process for hydroconversion of a hydrocarbonaceous feedstock.

In step (a) the feedstock is contacted at an elevated temperature and pressure in a first hydrocracking section in the presence of hydrogen with one or more catalysts to obtain a first hydrocarbon effluent stream. Step (a) can suitably be carried out at a temperature in the range of from 350-460° C., preferably in the range of from 370-430° C., a pressure in the range of from 50-250 bar, preferably in the range of from 100-200 bar, and a weight hourly space velocity in the range of from 0.1-2.0 $hr^{-1}$, preferably in the range of from 0.2-1.0 $hr^{-1}$. In the first hydrocracking section one or more catalysts can be used, and one or more beds of catalysts can be employed. The one or more catalysts in the first hydrocracking section may consist of any one or more metals or compounds thereof having hydrogenating properties. Preferably, the one or more catalysts in the first hydrocracking section comprise one or more Group 6b metals and/or one or more Group 8 metals on an alumina or silica-alumina support. The silica-alumina support may be amorphous or zeolitic. The metals copper, silver, tungsten, molybdenum, cobalt, nickel, platinum and/or palladium can advantageously be incorporated on or into a support. A preferred support to be applied in the catalyst(s) in the first hydrocracking section consists of alumina. This alumina may contain a low percentage of silica; suitably not more than 1% by weight of silica is present therein.

The metals to be applied may be used in the metallic, oxidic and/or sulphidic form. A preferred catalyst for the first hydrocracking section contains 8 to 14 percent by weight of molybdenum and 1 to 5 percent by weight of nickel, both metals being in the sulphidic form. In a particular embodiment the first hydrocracking section comprises a first catalyst bed comprising one or more Group 6b metals and/or one or more Group 8 metals on an alumina support, and a second catalyst bed which comprises one or more Group 6b metals and/or one or more Group 8 metals on an amorphous silica-alumina or zeolitic support.

In step (b), at least part of the first hydrocarbon effluent as obtained in step (a) is separated in a separating section into a gaseous stream and a liquid stream. Preferably, the entire first hydrocarbon effluent as obtained in step (a) is separated in a separating section into a gaseous stream, a light liquid stream and a heavy liquid stream. Suitably, the separation in step (b) is carried out at a temperature in the range of from 40-350° C., and a pressure in the range of from 2-250 bar, preferably in the range of from 4-200 bar.

Preferably, the heavy liquid stream as obtained in step (b) has a temperature higher than 200° C., preferably higher than 250° C.

Suitably, in step (b) use is made of four separation stages. In first separation stage separation can suitably take place at a relatively high temperature and relatively high pressure; in a second separation stage separation can take place at a relatively high temperature and relatively low pressure; in a third separation stage separation can suitably take place at a relatively low temperature and relatively high pressure; in a fourth separation stage separation can take place at a relatively low temperature and relatively low pressure.

The bottom product of the first separation stage is suitably the feed for the second separation stage, and the heavy liquid stream obtained in step (b) is suitably the bottom product of the second separation stage.

In step (c) at least part of the liquid streams as obtained in step (b) are separated in a fractionating section into a number of fractions of hydrocarbons including a heavy fraction of hydrocarbons that have a boiling point above 350° C. Preferably, the entire liquid streams as obtained in step (b) are separated in a fractionating section into a number of fractions of hydrocarbons including a fraction of hydrocarbons that have a boiling point above 350° C. Suitably, the bottom part of the fractionating section is operated at a temperature in the range of from 250-420° C., preferably in the range of from 320-390° C., and a pressure in the range of from 0.05-10 bar, preferably in the range of from 0.1-5 bar, and the upper part of the fractionating section is operated at a temperature in the range of from 0-200° C., preferably in the range of from 50-150° C., and a pressure in the range of from 0.01-10 bar, preferably in the range of from 0.02-5 bar.

In addition to the fraction of hydrocarbons that have a boiling point above 350° C., a naphtha fraction, a kerosene fraction, and a gas oil fraction can be recovered as desired products in step (c).

In step (d) at least part of the fraction of hydrocarbons that have a boiling point above 350° C. fraction as obtained in step (c) is contacted at an elevated temperature and pressure in a second hydrocracking section in the presence of hydrogen with one or more catalysts to obtain a second hydrocarbon effluent stream. Step (d) is suitably be carried out at a temperature in the range of from 230-460° C., preferably in the range of from 260-430° C., a pressure in the range of from 50-250 bar, preferably in the range of from 100-200 bar, and a weight hourly space velocity in the range of from 0.2-4 $hr^{-1}$, preferably in the range of from 0.4-2 $hr^{-1}$. In the second hydrocracking section one or more catalysts can be used, and one or more beds of catalysts can be employed. The one or more catalysts in the second hydrocracking section may consist of any one or more metals or compounds thereof having hydrogenating properties. Examples of suitable catalysts for use in the second hydrocracking section are moderately acid and strongly acid catalysts comprising one or more metals having hydrogenating activity on a support. Such catalysts include fluorine-containing sulphided catalysts containing nickel and/or cobalt and, in addition, molybdenum and/or tungsten or amorphous silica-alumina; sulphided catalysts containing or not containing fluorine which contain nickel and/or cobalt and, in addition, molybdenum and/or tungsten on crystalline silica-alumina as the carrier; and catalysts containing or not containing fluorine, comprising one or more noble metals from Group 8, particularly palladium, on amorphous or zeolitic silica-alumina. Preferably, the one or more catalysts in the second hydrocracking section comprises one or more Group 6b metals and/or one or more Group 8 metals on an alumina or a silica-alumina support. The silica-alumina support may be amorphous or zeolitic.

A suitable catalyst combination to be used in the process according to the invention is one or more sulphidic, i.e. sulphided, fluorine- and phosphorus-containing nickel-molybdenum catalysts on alumina as the support as the catalysts in the first hydrocracking section, and one or more sulphidic nickel-tungsten catalysts on a zeolitic silica-alumina support as the support as the catalysts in the second hydrocracking section.

In a preferred embodiment of the present invention, in step (e) at least part of the second hydrocarbon effluent stream as obtained in step (d) is separated in a separating section into a gaseous stream, a light liquid stream and a heavy liquid stream that has a temperature higher than 300° C., Preferably, the entire second hydrocarbon product stream as obtained in step (d) is separated in a separating section into a gaseous stream, a light liquid stream and a heavy liquid stream that has a temperature higher than 350° C. The separation in step (e) is suitably carried out at a temperature in the range of from 300-400° C., preferably in the range of from 350-390° C., and a pressure in the range of from 2-250 bar, preferably in the range of from 4-200 bar.

Suitably, in step (e) use is made of four separation stages. In first separation stage separation can suitably take place at a relatively high temperature and relatively high pressure; in a second separation stage separation can take place at a relatively high temperature and relatively low pressure; in a third separation stage separation can suitably take place at a relatively low temperature and relatively high pressure; in a fourth separation stage separation can take place at a relatively low temperature and relatively low pressure.

The bottom product of the first separation stage is suitably the feed for the second separation stage, and the heavy liquid stream obtained in step (e) is suitably the bottom product of the second separation stage. Moreover, the light liquid stream is the bottom product of the fourth separation stage.

In a particular attractive embodiment of the present invention in both steps (b) and (e) use is made of a total number of six separation stages. The separation stages number 1 and 2 are the warm ones for the first and second separation stages in step (b), the separation stages number 3 and 4 are the hot ones for the first and second separation stages in step (e), whilst the separation stages number 5 and 6 are relatively cold ones in which the third and fourth separation stages of step (b) and (e) are combined. In this way two separate heavy liquid streams are produced from the bottoms of separation stages number 2 and 4 and one combined light liquid stream is produced from the bottom of separation stage number 6. Hence the heavy liquid streams originating from steps (a) and (d) are suitably kept separated and are suitably fractionated separately in the bottom sections of the fractionating section whilst the light liquid streams from steps (a) and (d) are suitably mixed and suitably enter as a combined stream the middle section of the fractionating section. In such an embodiment the separation in separation stage number 1 and 2 can suitably be carried out at a temperature in the range of from 200-300° C. and a pressure in the range of from 5-200 bar, and the separation in the separation stage number 3 and 4 can suitably be carried out at a temperature in the range of from 350-400° C. and a pressure in the range of from 5-200 bar and the separation in the separation stage number 5 and 6 can suitably be carried out at a temperature in the range of from 40-80° C. and a pressure in the range of from 5-200 bar. In such an embodiment in step (e) the separation in the first and second separation stage is carried out at a higher temperature than the separation in the first and second separation stage in step (b).

In step (f) at least part of the liquid streams as obtained in step (e) are separated in a fractionating section into a number of fractions of hydrocarbons including a heavy fraction of hydrocarbons that have a boiling point above 350° C. Preferably, the entire liquid streams as obtained in step (e) are separated in a fractionating section into a number of fractions of hydrocarbons including a fraction of hydrocarbons that have a boiling point above 350° C. Suitably, the bottom part of the fractionating section in step (f) is operated at a temperature in the range of from 250-420° C., preferably in the range of from 300-400° C., and a pressure in the range of from 0.05-10 bar, preferably in the range of from 0.1-5 bar, and the upper part of the fractionating section is operated at a temperature in the range of from 0-200° C., preferably in the range of from 50-150° C., and a pressure in the range of from 0.01-10 bar, preferably in the range of from 0.02-5 bar.

In addition to the fraction of hydrocarbons that have a boiling point above 350° C. a naphtha fraction, a kerosene fraction, and a gas oil fraction can be recovered as desired products in step (f).

Preferably, in the process according to the present invention steps (c) and (f) are carried out in the same fractionating section which has two separate parts for fractionating respectively at least part of the liquid streams as obtained in steps (b) and (e).

Preferably, the separating sections in steps (b) and (e) comprise a first separating stage in which at least part of the first or second hydrocarbon product is separated into a first gaseous stream and a first liquid stream, and a second separating stage in which at least part of the first liquid stream is separated into a second gaseous stream and a second liquid stream, whereby in the second separating stage a lower pressure is applied than in the first separating stage.

In step (g) at least part of the heavy fraction of hydrocarbons that have a boiling point above 350° C. as obtained in step (f) is split into a major stream and a minor stream which both contain PCAs. Preferably, the entire fraction of hydrocarbons that have a boiling point above 350° C. as obtained in step (f) is split into a major stream and a minor stream.

In step (h) at least part of the major stream as obtained in step (g) is recycled to step (d). Suitably, the minor stream as obtained in step (g) is less than 5% wt on feedstock that is introduced into the first hydrocracking section. Preferably, the minor stream as obtained in step (g) is less than 3% wt, more preferably less than 1% wt on feedstock that is introduced into the first hydrocracking section.

In step (i) the minor stream as obtained in step (g) is recovered.

Preferably, the separation in step (e) is carried out at a higher temperature than the separation in step (b). The separation in step (e) is suitably carried out at a high temperature to ensure that the heavy liquid stream obtained has a temperature higher than 280° C., preferably higher than 320° C., more preferably higher than 350° C., and most preferably higher than 365° C. When the heavy liquid stream as obtained in step (e) and having such a high temperature is passed to the fractionating section in step (f) and only part of the fraction of hydrocarbons that have a boiling point above 350° C. as obtained in step (f) is recycled in step (g) to the second hydrocracking unit in step (d), a much less adverse impact of the build up of polyaromatic compounds is experienced. The heavy liquid stream as obtained in step (e) is allowed to maintain its high temperature by not cooling the heavy liquid stream. This means that in accordance with the present invention the adverse impact of polyaromatic compounds is suppressed, whereas at the same time the use of cooling equipment such as a heat exchanger and the subsequent need of a subsequent furnace for reheating the liquid stream can be avoided, making the present process particularly attractive.

Suitably, between steps (b) and (c) at least part of the liquid stream as obtained in step (b) can suitably be passed through a heat exchanger.

By carrying out the process according to the present invention attractive yields of naphtha, kerosene and gas oil can be obtained.

The hydrocarbonaceous feedstock to be fed to the first hydrocracking section of the present process may be of any origin. Preferred feedstocks boil within the range of from 325 to 550° C. Suitable examples also include flash distillates, i.e. oils obtained by vacuum flashing of atmospheric residues of crude petroleum oils. Other suitable examples of feedstocks are products from catalytic crackers or thermal conversion. Moreover deasphalted oils with a boiling range exceeding 550° C. may be processed.

FIG. 1 shows a simplified flow scheme of an embodiment of the present invention. FIG. 1 shows a line 1 via which a hydrocarbonaceous feedstock is passed through a heat exchanger 2. The feedstock thus heated is introduced, together with a hydrogen-containing gas which is provided via a line 3, into a first hydrocracking section 4. The first hydrocracking section can be provided with one or more catalyst beds. When the first hydrocracking section contains two or more catalyst beds, quench gas or a quench liquid may be introduced between the catalyst beds. The hydrocracked effluent is withdrawn from the hydrocracking section 4 via a line 5 and passed through the heat exchanger 2 to pre-heat the hydrocarbonaceous feedstock in line 1. The hydrocracked effluent is forwarded to a separation section 6 in which gaseous products such as hydrogen, hydrogen sulphide and ammonia, are removed and withdrawn via a line 7, and wherein a light liquid stream is obtained via a line 8 and a heavy liquid stream is obtained via a line 9. The gaseous products may be separated in a gas treating section to remove hydrogen sulphide, ammonia and any gaseous hydrocarbons that may have been formed. The thus purified hydrogen can suitably be recycled to the first hydrocracking section 4, e.g., via combining it with the hydrogen-containing gas in the line 3. The heavy liquid stream so obtained is then passed via line 9 through a furnace 10 and via line 11 introduced into a fractionating section 12. The light liquid stream is introduced via line 8 into fractionating section 12. In the fractionating section 12 the liquid streams are separated into a number of fractions of hydrocarbons including a fraction of hydrocarbons that have a boiling point above 350° C. Fractions of lighter hydrocarbons are removed from the fractionating section via outlets 13, whereas the fraction of hydrocarbons that have a boiling point above 350° C. is removed via line 14 and passed to a second hydrocracking section 15 to which a hydrogen containing gas is added via a line 16. The hydrocracked effluent from the second hydrocracking section 15 is forwarded via a line 17 to a separation section 18 in which gaseous products such as hydrogen, hydrogen sulphide and ammonia, are removed and withdrawn via a line 19, and wherein a light liquid stream is obtained via line 20 and a heavy liquid stream is obtained via a line 21. The gaseous products may be separated in a gas treating section to remove hydrogen sulphide, ammonia and any gaseous hydrocarbons that may have been formed. The thus purified hydrogen can suitably be recycled to the second hydrocracking section 15, e.g., via combining it with the hydrogen-containing gas in the line 16. The heavy liquid stream so obtained is then passed via line 21 to the fractionating section 12. The light liquid product stream is introduced via line 20 into fractionating section 12. In the fractionating section 12 the liquid product stream is separated into a number of fractions of hydrocarbons including a fraction of hydrocarbons that have a boiling point above 350° C. The fractionating section 12 comprises a wall 22 to segregate the heavy liquid streams obtained from the first hydrocracking section 4 and the second hydrocracking section 15. Fractions of lighter hydrocarbons are removed from the fractionating section via outlets 13, whereas the fraction of hydrocarbons that have a boiling point above 350° C. obtained from the liquid stream of the first hydrocracking unit 4 is removed via line 14 and passed to the second hydrocracking section 15. The fraction of hydrocarbons that have a boiling point above 350° C. obtained from the liquid stream of the second hydrocracking unit 15 is removed and split into a minor portion and a major portion. The minor portion is recovered via line 23 and the major portion is combined via line 24 with the fraction of hydrocarbons in line 14 that have a boiling point above 350° C. obtained from the liquid stream of the first hydrocracking section 4.

The following Examples will further elucidate the invention.

Example 1

Comparative Example

A heated coker heavy gas oil is together with hydrogen-containing gas introduced into a first hydrocracking section. In the first hydrocracking section use is made of a Ni—Mo alumina catalyst, whereby an outlet temperature of 390° C. is applied. The hydrocracked effluent is withdrawn from the first hydrocracking section, passed through a heat exchanger, and is then subjected to a four stage separation treatment. In a first separation stage the separation is carried out at a temperature of 276° C. and a pressure of 150 bar, and in a second separation stage the separation is carried out at a temperature of 280° C. and a pressure of 30 bar. The gaseous stream from the first separation stage is cooled in heat exchanger(s) to 60° C. and the resulting mixture of gas and liquid is routed to a third separation stage. The liquid stream from the third separation stage is depressured to 29 bars and routed to a fourth separation stage. Likewise the gaseous stream from the second separation stage is cooled to 60° C. and routed to a fourth separation stage. The light liquid stream from the fourth separation stage is heated in a heat exchanger and sent to the middle section of the fractionator. The heavy liquid hydrocracked product obtained from the second stage separation unit is heated in a furnace to a temperature of 380° C., and is introduced in a fractionating section of which the temperature in the bottom part is 350° C. and the temperature in the top part is 100° C. A naphtha fraction, a kerosene fraction and a gas oil fraction are withdrawn from the fractionating section. A heavy fraction boiling above 350° C. is withdrawn from the fractionating section. This heavy fraction is passed through a heat exchanger and then introduced, together with a hydrogen-containing gas, into a second hydrocracking section. In the second hydrocracking section use is made of a Ni—W on silica alumina catalyst, whereby an outlet temperature is applied of 380° C. The hydrocracked effluent so obtained is withdrawn from the second hydrocracking section, passed through a heat exchanger, and is then combined with the effluent of the first hydrocracking section. Hence effluents of both hydrocracking sections are subjected to the same separation treatment. Likewise the effluents of both hydrocracking sections are processed in a common fractionation section. In this common fractionating section the hydrocracked effluents so obtained are then separated into a naphtha fraction, a kerosene fraction, a gas oil fraction and the heavy fraction as described earlier. A bleed stream of the heavy fraction boiling above boiling above 350° C. being 2.0% wt on heavy coker gas oil as introduced into the first hydrocracking section is recovered from the fractionating section and not passed to the second hydrocracker section.

Example 2

According to the Invention

A multi-stage hydrocracking process is carried out as described in Example 1 except that (a) the effluent from the first hydrocracking section and the effluent from the second hydrocracking section are processed separately in dedicated hot separators; (b) the two heavy fractions boiling above 350° C. obtained from these dedicated hot separators are fractionated separately in dedicated bottom compartments of the fractionators; (c) a bleed stream of the heavy fraction boiling above 350° C. being 1.1% wt on heavy coker gas oil as introduced into the first hydrocracking section is recovered from the fractionating section for the heavy fraction of the second hydrocracking section; and (d) the heavy fraction produced in the first hydrocracking section is in its entirety passed through a heat exchanger and then introduced, together with a hydrogen-containing gas, into the second hydrocracking section.

It was found that Example 2 results in a significantly lower bleed requirement when compared with Example 1. This significantly lower bleed stream requirement improves the overall conversion of the feedstock and results in a higher yield of valuable lighter products such as high quality kerosene (20.1% (Example 1) versus 20.3% (Example 2)), and high quality gas oil (61.5% (Example 1) versus 62.0% (Example 2)). In addition, it is observed that the total yield of naphtha, kerosene and gas oil is now 93.0% compared with 92.1% as obtained in Example 1.

Example 3

According to the Invention

A multi-stage hydrocracking process is carried out as described in Example 2 except that (a) the temperatures in the first and second separation stages after the second hydrocracking section are 370° C. and 374° C. respectively; (b) no heat exchanger is used between the outlet of the second stage hydrocracking section and the heavy liquid stream inlet of the fractionating section; (c) no furnace is used between the outlet of the second hydrocracking section and the heavy liquid stream inlet of the fractionation section; and (d) a bleed stream being 0.6% wt on heavy gasoil as introduced into the first hydrocracking section was recovered from the fractionating section and not passed to the second hydrocracker section.

It was found that Example 3 results in a considerable saving of equipment costs as well as a significantly lower bleed requirement when compared with Example 2. This significantly lower bleed stream requirement improves the overall conversion of the feedstock even further and results in an even higher yield of valuable lighter products such as high quality kerosene (20.3% (Example 2) versus 20.4% (Example 3)), and high quality gas oil (62.0% (Example 2) versus 62.3% (Example 3)). In addition, it is observed that the total yield of naphtha, kerosene and gas oil is now 93.4% compared with 93.0% as obtained in Example 2. Moreover, in Example 3 a reduction of energy consumption (fuel gas and electricity) of no less than 7% is established when compared with Example 2 or Example 1.

Hence, it can only be concluded that the processes according to the present invention constitutes a considerable improvement over a conventional multi-stage hydrocracking process.

What is claimed is:

1. A process for the hydroconversion of a hydrocarbonaceous feedstock comprising the steps of:

(a) contacting the hydrocarbonaceous feedstock at a first elevated temperature and a first pressure in a first hydrocracking section in the presence of hydrogen with a first hydrocracking catalyst to obtain a first hydrocarbon effluent stream;

(b) separating at least part of the first hydrocarbon effluent within a first separating section into a first gaseous stream, a first light liquid stream of hydrocarbons boiling at or less than 350° C. and a first heavy liquid stream of hydrocarbons boiling above 350° C.;

(c) separating the first light liquid stream and the first heavy liquid stream within a fractionating section having a bottom part operated at a temperature in the range of from 300-400° C. and a pressure in the range of from 0.05-10 bar and an upper part operated at a temperature in the range of from 0-100° C. and a pressure in the range of from 0.01-10 bar to yield a number of fractions of hydrocarbons including a heavy fraction of hydrocarbons that have a boiling point above 350° C.;

(d) splitting at least part of the heavy fraction of hydrocarbons into at least two parts including a major stream and a minor stream, wherein the minor stream has a weight that is less than 5% wt, based on the weight of the hydrocarbonaceous feedstock;

(e) contacting the major stream at a second elevated temperature and second pressure in a second hydrocracking section in the presence of hydrogen with a second hydrocracking catalyst to obtain a second hydrocarbon effluent stream;

(f) separating at least part of the second hydrocarbon effluent stream within a second separating section into a second gaseous stream, a second light liquid stream and a second heavy liquid stream;

(g) separating the second light liquid stream and the second heavy liquid stream within the fractionating section.

2. A process according to claim 1, wherein step (a) is carried out the first temperature in the range of from 350-460° C., the first pressure in the range of from 50-250 bar and a weight hourly space velocity in the range of from 0.1-2.0 hr-1, and the first hydrocracking catalyst in the first hydrocracking section comprises a Group 6b metal or a Group 8 metal, or both, on an alumina or a silica-alumina support.

3. A process according to claim 1, wherein step (d) is carried out at the second elevated temperature in the range of from 230-460° C., the second pressure in the range of from 50-250 bar and weight hourly space velocity in the range of from 0.2-4 hr-1, and the second hydrocracking catalyst in the second hydrocracking section comprises a Group 6b metal or a Group 8 metal or both, on an alumina or a silica-alumina support.

4. A process according to claim 1, wherein the separation in step (b) is carried out at a temperature in the range of from 40-350° C. and a pressure in the range of from 2-250 bar.

5. A process according to claim 1, wherein the separation in step (f) is carried out at a temperature in the range of from 40-350° C. and a pressure in the range of from 2-250 bar.

6. A process according to claim 1, wherein the second heavy liquid stream has a temperature higher than 250° C.

7. A process according to claim 1, wherein the first heavy liquid stream has a temperature higher than 250° C.

8. A process according to claim 1, wherein the minor stream as obtained in step (g) is less than 3% wt, based on the weight of the hydrocarbonaceous feedstock that is introduced into the first hydrocracking section.

9. A process according to claim 1, wherein the separation in step (f) is carried out at a higher temperature than the separation in step (b).

10. A process according to claim 1, wherein between steps (b) and (c) at least part of the first hydrocarbon effluent stream is passed through a heat exchanger and exchanges heat with the hydrocarbonaceous feedstock.

* * * * *